US005851098A

United States Patent [19]

Buckenauer et al.

[11] Patent Number: 5,851,098

[45] Date of Patent: Dec. 22, 1998

[54] SYSTEM FOR ACCOMMODATING TEMPORARILY STORING AND OUTPUT OF MOVABLE OBJECTS

[75] Inventors: Günter Buckenauer, Baldham; Roland Peiz; Hans Beutler, both of München, all of Germany

[73] Assignee: Maurer Sohne GmbH & Co. KG, Munich, Germany

[21] Appl. No.: 969,549

[22] Filed: Nov. 13, 1997

Related U.S. Application Data

[63] Continuation of Ser. No. 617,883, filed as PCT/EP95/03624, Sep. 14, 1995 published as WO96/08625, Mar. 21, 1996, abandoned.

[30] Foreign Application Priority Data

Sep. 16, 1994 [EP] European Pat. Off. .... PCTEP9403113

[51] Int. Cl.[6] ..... E04H 6/00

[52] U.S. Cl. ..... 414/263; 414/253; 414/259

[58] Field of Search ..... 414/253, 259, 414/263, 255, 256, 260; 104/162, 44, 48; 198/748

[56] References Cited

U.S. PATENT DOCUMENTS

| | | | |
|---|---|---|---|
| 1,709,914 | 4/1929 | Klanke | 414/259 |
| 2,899,087 | 8/1959 | Jacobsen | 414/253 |
| 3,419,161 | 12/1968 | Hagel | 414/255 |
| 3,419,162 | 12/1968 | Hagel . | |
| 3,513,992 | 5/1970 | Handler | 414/263 |
| 4,039,089 | 8/1977 | Kochanneck | 414/263 |
| 4,264,257 | 4/1981 | Saurwein | 414/259 |
| 4,968,208 | 11/1990 | Friberg | 414/256 |
| 4,976,580 | 12/1990 | Knakrick | 414/263 |
| 5,286,156 | 2/1994 | Ikenouchi et al. | 414/256 |
| 5,320,473 | 6/1994 | Arnold et al. | 414/253 |
| 5,651,319 | 7/1997 | Sugahara | 104/162 |

FOREIGN PATENT DOCUMENTS

| | | | |
|---|---|---|---|
| 350464 | 1/1990 | European Pat. Off. | 414/263 |
| 1045075 | 11/1958 | Germany . | |
| 1094964 | 12/1960 | Germany . | |
| 1271367 | 6/1968 | Germany . | |
| 1684721 | 4/1971 | Germany . | |
| 896624 | 5/1962 | United Kingdom | 414/259 |
| 9112396 | 8/1991 | WIPO . | |

*Primary Examiner*—Thomas J. Brahan
*Attorney, Agent, or Firm*—Birch, Stewart, Kolasch & Birch, LLP

[57] ABSTRACT

The subject of the present invention is a system for temporary storage and output of pilotless, movable vehicles in a parking garage as well as for transferring the pilotless vehicles froma transport platform 3 to a parking place and vice versa, including a means for lifting the vehicles, for moving them in the lifted position and for putting them down in another position. Carrier arms 13, 14, 15, 16 perpendicularly extending until into the area of the vehicle wheels are arranged on a longitudinal carrier 17 movable under the vehicle in longitudinal direction, at least two of the carrier arms being pivotable from a position directed in direction of the longitudinal carrier into the rectangularly extended position in which they under pressure bear on the lower area of the vehicle wheel and lift it from the standing place. It is possible to lift only the front wheels of the vehicle by means of four carrier arms 13, 14, 15, 16 and to displace the vehicle rolling on the rear wheels or two additional carrier arms are provided for lifting all four wheels of the vehicle.

30 Claims, 15 Drawing Sheets

SYSTEM FOR ACCOMMODATING TEMPORARILY STORING AND OUTPUT OF MOVABLE OBJECTS

This application is a continuation, of application Ser. No. 08/617,883, filed as PCT/EP95/03624 Sep. 14, 1995 published as WO96/08625, Mar. 21, 1996, now abandoned.

FIELD OF THE INVENTION

The invention relates to a system for accommodation, temporary storage and output of movable objects, in particular of pilotless locomotive vehicles each of which is controlled by means of a transmitter device of a tender. The tender is rotatably supported about a central axis and has at least one carrier arm. Each of the pilotless vehicles is taken over from at least one entry platform and is placed on a free platform of one of a number of platforms or is again taken up, respectively, from that one and is transferred to an exit platform. The platforms are arranged side-by-side in a radial direction along a helical running rail of the tender.

BACKGROUND OF THE INVENTION

In buildings which are intended for accommodating a plurality of vehicles such as multistory car parks or large-scale parking garages, it is necessary to dispose as many vehicles as possible in the available parking spaces. If the parking places and the driveways are designed such that every parking place can be entered separately, a large amount of the total area remains unused, since approximately the same area occupied by a parking place has to be added thereto for the driveway and the room for maneuvering. Thus, about half of the area available remains unused.

For saving room, devices have already been realized in which the vehicles are disposed on movable parking places in the manner of a paternoster lift or of a horizontally arranged conveyor. Depending on the demand, only one of the plurality of parking places is moved in front of the entry and exit. Such a system requires complex drive mechanisms whereby every vehicle entry or exit requires all parking places with the vehicles located thereon to be moved.

Another known system in which the parking places are rigidly disposed one beside and/or above the other uses at least one transport platform. The platforms are provided for accommodating the vehicle and bringing it to a parking place onto which it is then transferred. This system is less large-scale. For exiting, the car is brought to the exit with the transport platform. Herein, the vehicle has to be transferred from the transport platform to the parking place by using the vehicle drive.

In a mechanical parking system of the generic kind, the parking places are arranged along a helix in a radial direction. In the remaining cylindrical hollow space a transport device referred to as tender moves on a rail also bent along a helix. At least one tender arm is provided and is supported on the rail by means of two running wheels. A vehicle to be parked can be transferred upwardly or downwardly, respectively, on the arm. The tender rotates about its own axis for the lifting or lowering operation so that a vehicle can be moved from an entry platform to a free parking place or from the latter, respectively, to an exit platform by means of the arm.

SUMMARY OF THE INVENTION

The invention is based on the object of further developing a generic system for transferring vehicles with braked front-wheels and/or rear wheels. The system is carried out completely automatically so that no driving is needed for the vehicle. Furthermore, the system to a high degree is to meet the rough operating conditions occurring in everyday use with respect to reliability of operation, stability and resistance to wear and is to meet winter operating conditions.

This object is solved by a system for receiving, temporarily storing and outputting vehicles by a transmitter device of a tender supported rotatably about a central axis, comprising: at least one carrier arm is taken over from at least one entry platform and placed onto a free platform of a plurality of platforms and from said free platform, said at least one carrier arm is transferred to an exit platform, wherein the platforms are arranged one beside the other in a radial direction along a helical running rail for the tender; the transmitter device supported on the at least one carrier arm of the tender comprises a frame means movable in longitudinal direction between wheels of a vehicle standing on a platform; and at least four carrier arms perpendicularly extending until the area of the vehicle wheels is arranged on said frame means, and at least two of the carrier arms are pivotable such that said at least two arms bear on the lower area of the a respective vehicle wheel with pressure and lift the wheel from the platform into a stationary position.

By means of the transmitter device in accordance with the present invention, it now is possible to take up the vehicle placed on an entry platform, to move it onto the tender arm and using the tender arm moving in upward and downward directions along the helical rail to transfer it to the front of a parking box for placing it on the platform of the parking box or vice versa. When picking up a parked vehicle, it is possible to pull the latter from the parking place onto the tender arm and to hand it over to an exit platform from which it can be driven away by the driver.

The transmitter device advantageously comprises frame means movable in a longitudinal direction between the wheels of a vehicle standing on the platform, and at least four carrier arms perpendicularly extending until the area of the vehicle wheels being disposed on said frame means. In accordance with the present invention, at least two of these arms are pivotable from a position directed to the frame means into the perpendicularly extended position in which they bear on the lower area of the respective vehicle wheel and lift the latter from the floor space. The frame means is essentially formed by two longitudinal carriers extending in a longitudinal direction of the tender arm and connected to one another by a cross beam in the region of the interior end directing to the central axis of the tender arm and the outer end directing to the tender carrier arm. While four carrier arms are correlated to the front wheels of a vehicle, of which the two carrier arms directed to the tender axis are rigidly disposed in the area of the inner ends at the longitudinal carriers and the two other carrier arms are advantageously pivotable against the backside of the front wheels for pressing those against the rigidly lifted carrier arms and lifting them, only two carrier arms diametrally arranged with respect to the wheel axle of the vehicle are correlated to the two rear wheels of the vehicle. The embodiment using the above-described four front carrier arms is sufficient for the case when the rear wheels of the vehicle can roll on respective running surfaces of the tender arm or on the parking place floor, respectively. This means that the rear wheels of the vehicle to be moved are not braked.

However, when the rear wheels are braked, such as in a vehicle having an automatic transmission and theft protection, the device in accordance with the present invention is equipped with two further pivotable carrier arms correlated to the rear wheels of the vehicle. One of the further pivotable carrier arms is pivotable against the front side of a rear wheel and the other is pivotable against the rear side of the other rear wheel of the vehicle. In this way all four wheels of the vehicle are taken and jacked up by the transmitter device in an advantageous manner so that the vehicle is transferred into the box and out of it, respectively, in a piggyback process.

To adapt the present transmitter device to differing wheel bases, the distance between the carrier arms correlated to the rear wheels of the vehicle and the carrier arms correlated to the front wheels of the vehicle is adjustable. This adjustment can be effected mechanically with the aid of a screw spindle or hydraulically with the aid of a piston/cylinder arrangement or electromotorically with a toothed rack. By arranging a pivotable carrier arm before the one rear wheel and the other pivotable carrier arm behind the other rear wheel, the horizontal forces created upon contact of the carrier arms with the rear wheel tires counterbalance one another. As compared to a system in which both carrier arms would hit against the front sides of the rear wheel tires, this present system has the advantage of avoiding danger to the two front wheels being pulled out of their support positions by the horizontal forces.

For reducing friction forces between the carrier arms and the vehicle wheels, freely rotatable rollers are provided on the carrier arms in the area of the long sides coming into contact with the vehicle wheels. The frame means itself is displaceable onto a corresponding platform by means of running rolls on the top side of two running courses extending on the sides in a longitudinal direction of the tender arm. Furthermore, it is provided that the running courses have laterally set edges against which the carrier arms supported by rollers on the top side of the running courses run by means of guide rolls rotatable about a vertical axis. In this way, the transmitter device in accordance with the present invention is guided between the lateral set edges of the running courses in its longitudinal movement.

The tender preferably comprises four tender arms each of which is connected with a transport means, e.g. a synchronous belt drive, for driving the frame means of the transmitter device. Of course, also other driving systems, e.g. a chain drive or hydraulic drive, can be used. The synchronous belt drive can comprise an endless toothed belt guided over horizontal toothed disks where the disks are supported on the inner and outer end, respectively, of the tender carrier arm. This vertical arrangement of the toothed belt guarantees that dirt cannot deposit on the toothed belt, which might cause premature destruction of the drive means. The transmitter device preferably has its rear end connected to the toothed belt by clamping joints and thus, depending on the direction of rotation of the toothed disk, the vehicle can be pushed from the tender arm saliently into a parking box or again pulled back, respectively, from the parking box onto the tender arm. Therein, the transmitter device can be displaced during picking up of a parked vehicle from a parking box from the tender arm into direction of the parking box to such extent until the two rigid carrier arms approximately are standing on the level of the front wheels of the vehicle placed on the entry platform. The two pivotable carrier arms at this point are still in a rest position, where they are in parallel to the two longitudinal carriers of the frame means of the transmitter device. Thereby, they can be pushed in between the two front wheels. As soon as the rigid carrier arms stand in their end positions and the transmitter means stops, the two pivotable carrier arms advantageously are pivoted by 90° into a position parallel to the other respective carrier arms using two hydraulic presses. In the end phase of the pivotal movement, the pivotable carrier arm contacts the backside of the tire of the front wheel and presses the front wheel up to the parallel final position in an upward direction during the remainder of the movement. The two front wheels are then lifted away from the floor of the parking place.

Preferably, a pole by which the vehicle can be moved further to the outside in a radial direction is arranged between the transmitter device and the toothed belt. When the vehicle is in the entry and/or exit boxes, respectively, for entering and/or leaving of persons and is pushed to the outside farther than in the parking boxes, this results in a greater lateral distance from the vehicle to the adjacent boxes. This permits a comfortable entering and leaving of the vehicle for the passengers without the opened doors being hemmed in by the neighboring walls.

For securing the pole during displacement of the transmitter device against twisting and/or torsion, the pole preferably is formed by a rotationally stable square string piece and has a guide means received between slide members. After a given beginning path the transmitter device can be guided by guide rolls arranged on the carrier arms at lateral set edges of a parking place. For achieving a volume filling degree as high as possible for the system, the individual parking places intersect in their radially inner section so that due to the narrow space conditions no lateral set edges are present at the parking places and thus, no guiding of the transmitter device by the guide rolls on the carrier arms is possible. In this area the pole guidance guarantees safe and accurate guiding of the transmitter device.

The two longitudinal carriers of the transmitter device in an advantageous manner are arranged within the track of the load-transmitting running rolls and not within the track of the load-transmitting running wheels. Due thereto, a low construction of the transmitter device and a very simple construction can be achieved, because the loads are introduced into the running areas directly by the running rolls of the carrier arms and the transmitter means essentially has to take over and absorb only its own weight.

An advantage of the four-wheel transmitter device is that the loads from the proper weight of the vehicle which are independent of the track are always transferred in the track of the running rolls arranged on the carrier arms of the transmitter device to the platform or the running paths, respectively. In one embodiment of the transmitter device, in which the vehicle rolls on both rear wheels and is jacked up with the front wheels only, the position of load introduction depends on the different tracks of the vehicles.

The pivotable swing arms correlated to the rear wheels of the vehicle advantageously are supported on a sledge which itself is guided on the longitudinal carriers by means of bearings. The distance between the front and rear carrier arms can be varied by means of this sledge and a suitable drive so that the transmitter device can be adapted to various wheel bases of different vehicles. The bearings with which the sledge is guided on the longitudinal carriers preferably are polytetrafluoroethylene (PTFE) slide bearings. In addition, the sledge at its two longitudinal sides has running rolls with which it is supported in its rest position after swinging of the carrier arms onto the running paths of the tender arm or the platform, respectively.

To make sure that the carrier arms during the return swing into their rest positions extending in longitudinal direction of the longitudinal carriers opposite to the running paths of the tender arm or the surface, respectively, of the platform are guided in a contactless manner, it is advantageous that they are lifted during swinging into the longitudinal direction of the longitudinal carriers along an inclined plane.

The tender arms can be adjusted by a corresponding rotational movement of the tender with respect to the platforms arranged one beside the other and around the tender in a radial direction. Herein, one or several entry or exit platforms, respectively, can be provided beside the parking box platforms, having identical constructions with one another. Therein, it is provided in an advantageous manner that each platform is formed by a sheet metal extending over a maximal vehicle length, with at least a lateral set of edges, which bears on a framework subconstruction. The framework subconstruction comprises at least two longitudinal carriers absorbing the locally variably attacking loads. The carriers are supported on at least two cross carriers transferring the loads into building posts. Therein, the inner platform ending (facing the tender axis) can be supported on consoles of the tender running rail using a cross carrier.

In an advantageous manner, the sheet metal is made from wear-resistant material anticorrosive with respect to de-icing salt solutions, such as ferritic chromium-alloyed steel in particular. This material has a high resistance to wear in inhibiting corrosion, and is resistant against weak salt solutions with simultaneous high resistance to wear due to the low nickel content. The steel has a substantially lower thermal expansion coefficient as compared to austenitic steels so that the high thermally induced distortion occurring in welding of austenitic steels does not occur. Also the price is about 50 percent of the price of austenitic chromium nickel steels. Preferably a ferritic chromium-alloyed steel having 10.5 to 12.5 percent of Cr with only 0.3 to 1.0 percent of Ni is used.

Apart from its covering function, the sheet metal also has to take over certain support functions.

Thus, the sheet metal absorbs the dead weight of the transmitter device which is transferred via the running rolls arranged on the two longitudinal carriers of the transmitter device into the un-stiffened part of the covering sheet. Furthermore, the horizontal forces created due to braking or starting, respectively, of the tender at the supporting consoles of the tender rail are transmitted to the platform extending in a direction inside of the housing, which forces have to be diverted via the covering sheet serving as a thrust area into the posts. Finally, due to the different tracks of the parked vehicles, the rear or front wheels, respectively, of the vehicle may be arranged laterally with respect to the two stiffening longitudinal carriers of the platform. For avoiding local stiffening of the covering sheet in this area, it was shown by means of a "Finite Element Examination" that a sheet metal of 4 mm thickness can absorb these vehicle wheel loads by a plate and membrane effect. For absorbing the standard forces from the membrane effect, bend-proof marginal carriers have to be created on the two long margins of the bottom sheet by setting edges. These set edges are at the same time necessary for avoiding a lateral flow of water flowing down from the vehicles.

In accordance with a further advantageous feature of the invention, the sheet metal is held on the longitudinal or cross carriers by clamping forces only. Furthermore, a shock-absorbing layer made out of wear-resistant elastic material, rubber in particular, is provided between the sheet metal and the subconstruction. This layer prevents direct contact between the covering sheet and the longitudinal or cross carriers, respectively. The elastic material arranged over the longitudinal carriers, which e.g. may be built as rubber strips, improves load transfer from the running rolls of the pivotable carrier arms of the transmitter device and prohibits wear possibly caused by a relative movement of the sheet metal with respect to the longitudinal carriers.

For fixing the front wheels of a vehicle, flats can be screwed on the top side for avoiding welding which causes distortions. The clamps for fixing the sheet metal on the carriers as well as of the flats for the front wheels are screwed with shot-in threaded bolts. By using shot-in threaded bolts, throughholes are avoided through which water might drop onto the cars parked below.

In an advantageous manner, all platforms are inclined by about 2 percent in direction to the building outside. Due to this slope, dripping water can be guided away to the outside into a ring channel of the building. Due to the corrosion-inhibiting effect of the material used, it has to be avoided that water containing de-icing salt can stay on the surface of the bottom sheet for long periods of time.

As the tender arms are correlated to certain platforms temporarily, person protection means has to be provided on the inside of at least one of the entry and exit platform or both which can be turned away and close the platform area with respect to the tender area as long as persons are present in the area of the platform. The parking box platforms need not be protected by such means since no persons are present in the parking box area.

It has to be taken into consideration that in all mechanical parking systems the access time and/or the conveying capacity per hour of the transport system is the decisive factor for the economic efficiency and acceptance of the parking system. In multi-story car parks with linear parking systems in which the horizontal and vertical movements are effected subsequently, access time is very long so that the conveying capacity is low. In a parking garage equipped with the parking system of the present invention, however, access time can be substantially reduced to up to two minutes per vehicle. Here, the lifting and/or the lowering movement, respectively, and the rotational movement of the tender can be carried out simultaneously. Such short access times can only be realized by parallel action of various transport operations and by high transport speed on the tender or the transport with the transmitter device, respectively.

For obtaining optimum conveyer capacity of the transport system, the tender comprises four carrier arms displaced with respect to one another at an angle of 90° and that four entry platforms each are arranged in cross-wise manner with respect to the tender arms. The full transport capacity of the four-arm tender, therein, can only be utilized sufficiently, if pushing in of the vehicles from the entry platforms to the four tender arms can occur simultaneously and, if possible, the subsequent transmitting from the tender arm to the parking place is effected at the same time. Because the arrangement is shifted by each of the tender arms at 90° increments, an arrangement of the entry platforms correspondingly are displaced by 90° and an arrangement of the exit platforms are shifted with respect to the entry boxes by 45°. In the individual stories of the parking system the vehicles are parked into parking places, displaced by 90°. Since after some time due to the vehicles leaving the parking garage at random times, this 90° arrangement of free parking places is lost. To maintain the 90° arrangement, at least two additional free parking places displaced by 90° must be selected by a computer program for each case, so that at least two parking operations can occur simultaneously.

If for space reasons the above-described cross-wise arrangement of the entry and exit platforms is not possible, at least three adjacent entry platforms combined with three exit platforms displaced by 90° relative to each other have to be maintained.

The tender then only picks up three vehicles from their parking places, thus leaving one arm free. This free arm is moved before an entry platform. The second tender arm displaced by 90° thereto then stands in front of an exit platform. Thus, it is possible to push a vehicle onto the free tender arm simultaneously while another vehicle is pushed from the charged tender arm into the exit platform. Subsequently, the tender moves further by an angle of 90° ±dz so that a vehicle can be picked up onto the tender arm just freed at the entry platform and simultaneously a vehicle can be pushed from the next charged tender arm onto the next exit platform.

Preferably, the displacement speed of the transmitter device is controllable such that an unloaded transmitter device can be moved quicker than a loaded transmitter device. Since the extension of the rear portion of the transmitter device for jacking up the rear wheels of a vehicle always is a time-consuming action which is not performed when the rear wheels are not braked, the driver in all cases is asked to loosen the parking brake when entering. Only in vehicles with automatic transmission blocking of the rear wheels can not be loosened during parking.

For now, checking in a vehicle standing on an entry platform whether or not the rear wheels are blocked, the extension of the sledge of the transmitter device and the turning of the carrier arms for the rear wheels of a vehicle is dependent on a current consumption of the synchronous belt drive motor exceeding a given threshold value. Therein, the method of loading vehicles is as follows:

The transmitter means with the two carrier arm pairs seizes the two front wheels of the vehicle and during swinging out of the carrier arms lifts the two front wheels. Thereafter, the transmitter device moves in direction to the tender arm. Therein, current consumption of the drive motor is measured, as it is an indicator for the driving resistance encountered. The rolling resistance value for a vehicle tire amounts to only about 1.5 percent of the tire load in contrast to about at least 50 percent of the tire load in case of sliding friction when dragging the blocked rear wheels on the base. The displacement resistance of the lightest vehicle with braked rear wheels is substantially higher than that of the heaviest possible vehicle with free-running rear wheels. Independent from the weight of the vehicle, thus, it can be found on basis of the current consumption of the drive motor of the transmitter device, whether the rear wheels are blocked or not. Only in a few cases of blocked rear wheels then the rear part of the transmitter means is extended. By this measurement it is achieved in advantageous manner that the conveyor capacity per hour is almost doubled.

In an advantageous embodiment of the invention measures are provided for which secure the position of the vehicle on the tender or the transmitter means, respectively, against displacement. Thereby, it is avoided that the vehicle charged on the tender can jump out of the locating means of the transmitter means due to centrifugal forces during rotation of the tender. This becomes a problem in particular when the wheels only are accommodated between the two front swing arms and the vehicle is not held by the rear arms. Furthermore, it has to be taken into account that the centrifugal force linearly depends on the mass of the vehicle and squarely on the speed of the center of gravity of the vehicle. In case of large vehicles having a fully loaded luggage trunk the center of gravity of the vehicle moves radially to the outside into the region of higher rotational speeds. The centrifugal forces created therein can be absorbed by two devices preferably. Therein, the first device is located at the support position of the front tires on the front carrier arms of the transmitter device and the second device is located behind the rear bumper. Since the bumper can absorb only limited forces, a subdivision of the centrifugal force onto the front and rear device can be achieved by using the elastic effect of the vehicle tires.

The device arranged at the rear bumper preferably is intended for the rare case that the toothed belt holding the transmitter device in radial direction tears apart. Then, the absorption of the centrifugal force can be made by the barrier of the rear bumper alone. It is true that under these conditions a damage of the bumper may occur, however, damage of the entire vehicle by the displacement from the tender is avoided.

As a rule, safe reception of the vehicle on the tender must be guaranteed in case of rotation of the tender. Therein, a safety factor has to be accounted for also for the case that e.g. the luggage trunk is loaded, the front axle is unloaded and thus the holding forces on the front swing arms are reduced.

Preferably the means include at least one pivotable stirrup engaging at the radially external side of a wheel of the two front wheels of the vehicle. This stirrup can be arranged at the tender arm or at the two front swing arms. By a motor swinging the stirrup to the vehicle wheel, the vehicle on the tender is secured against being displaced due to centrifugal forces. The swing drive motor can be controlled such that it switches off when reaching the pre-adjustable pressing force of the stirrup against the tire. Furthermore, it alternatively is possible to provide for a lever on each of the swing arms attacking on the rear side of the front wheels of the transmitter device. The lever secures the vehicle against displacement due to centrifugal forces. Therein, the lever can be sprung shortly and hard for balancing differences in sizes of the tire due to different diameters of different types of vehicles.

In an advantageous embodiment the safety measures include a flap on the transmitter means, which on the backside of the vehicle can be fold against the bumper thereof for securing the position of the vehicle on the transmitter device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and, thus, are not limitative of the present invention, and wherein.

DETAILED DESCRIPTION OF THE PREFERRED EMBODIMENTS

Figure 1:
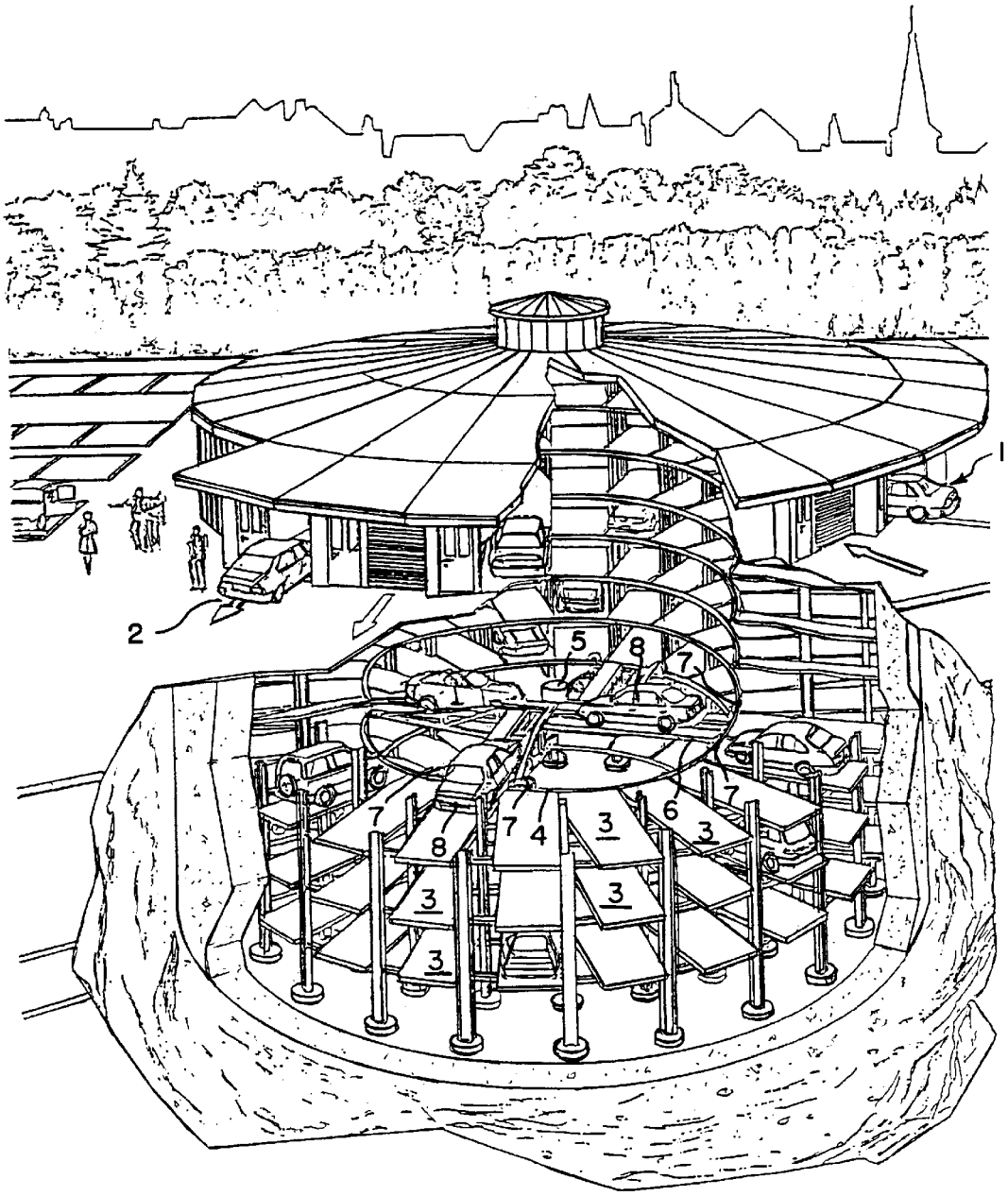
FIG. 1 shows a partly broken perspective view of a system in accordance with the invention with partly occupied parking boxes.

The system shown in FIG. 1 forms a parking garage located below ground, which in its basic structure if formed as hollow cylinder. In the above ground part the entry is located at 1 and the exit is located at 2. A plurality of parking places 3 which in its longitudinal direction are arranged radially and which with their radially outer ends are adjacent to the inside wall of the hollow cylinder is arranged in the interior of the hollow cylinder. The parking places 3 are arranged along a helical line so that they lie one beside the other without interruption from the first up to the last and from the uppermost, respectively, to the lowest most parking place. On their radially inner side they are connected with one another by a rail 4 which correspondingly also extends helically.

In the inside cylindrical space not occupied by the parking places 3 a so-called tender 5 having four carrier arms 6 is arranged. Each of the carrier arms of the tender is supported on the rail 4 by means of two running wheels 7 each. On the four arms of the tender 5 four vehicles 8 to be parked can be in common transported in upward or downward, respectively, directions. The tender 5 turns about his own axis during lifting or lowering operations so that each of the four arms can go to a respectively free parking place or an entry or exit platform, respectively.

The transmitter device 9 in accordance with the present invention essentially comprises one frame means moveable in longitudinal direction between the front wheels 10 and the rear wheels 11 of a vehicle 8, on which frame means four carrier arms 13, 14 extendable perpendicularly into the region of the front wheels 10, for the front wheels 10 and carrier arms 15, 16 for the rear wheels 11 are provided for.

The frame means 12 comprises two longitudinal carriers 17 extending in longitudinal direction of the tender arm 6 and connected to one another in the area of the inside end directed to the central tender axis and the outer end directed to the tender carrier arm end by cross carriers 18, 19. The longitudinal carriers e.g. are 5.60 m long and consist of RRO (rectangular) profiles. The inner cross carrier 18 directed to the central tender axis is broadened by means of a sheet 20 put onto the longitudinal carriers on top and bottom. The outer cross carrier 19 lying in direction of the tender arm consists of a square tube in cross section. The carrier arms 13 are rigidly supported on the inside end of the frame means 12, while the carrier arms 14 can be turned about a point of rotation 21 by means of two hydraulic pistons by 90° in a horizontal plane. The carrier arms are equipped with running rolls 22 in about the center of its longitudinal extension with which the carrier arm can bear on the running face of the tender arm 6.

Figure 7:
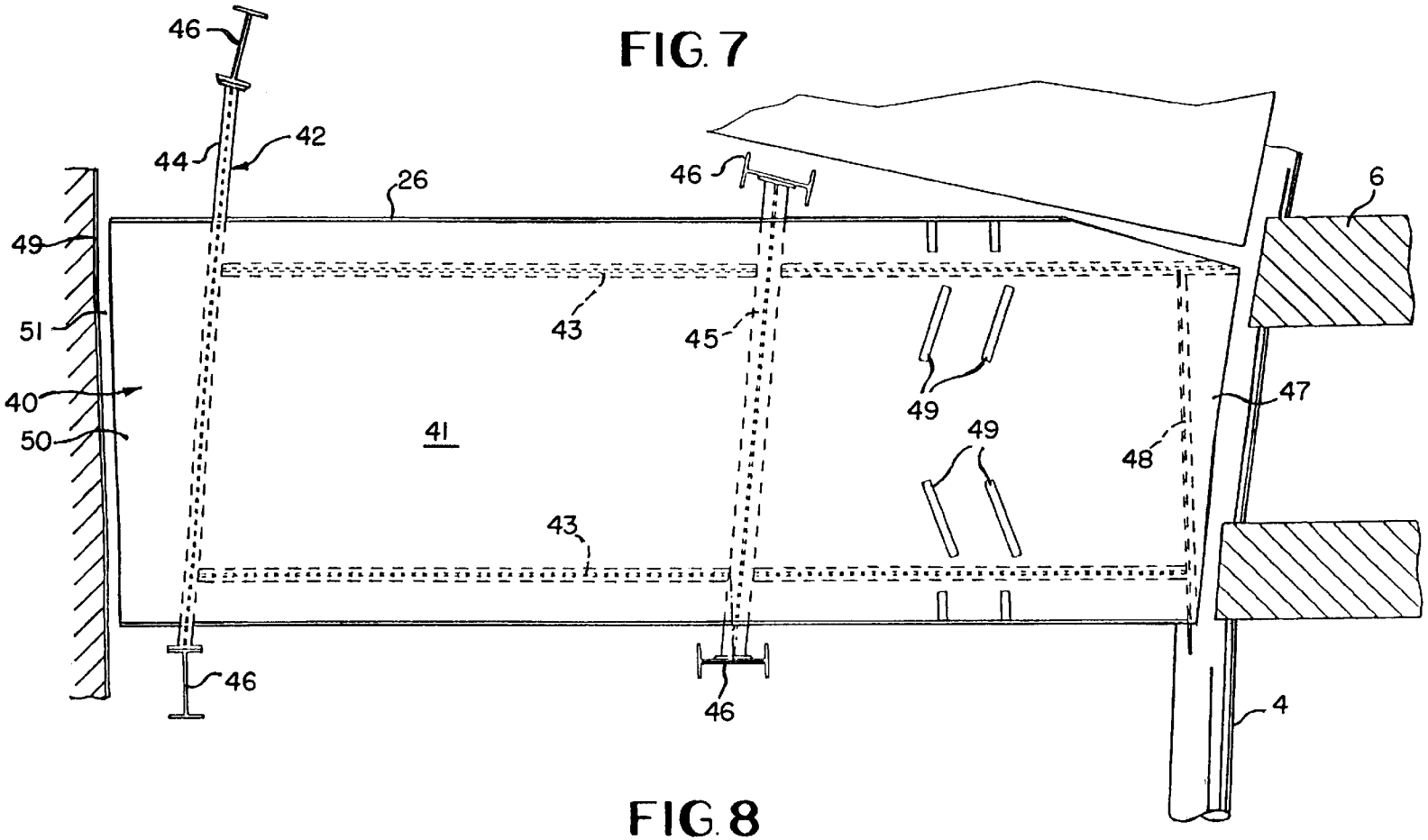
FIG. 7 shows a top view onto the bottom sheet of a platform.
Figure 8:
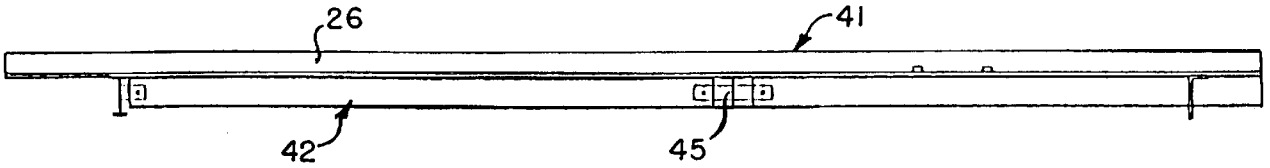
FIG. 8 shows a longitudinally cut view according to the platform of FIG. 7.

Furthermore, guide rolls 24 are disposed on the outer ends of the carrier arms 13, 14, 15, 16 which roll the vehicle 8 which is laterally guided on the sides on set edges 25 of the running face 23 or 26, respectively, of a parking place 3 (see FIGS. 7 and 8).

Figure 5:
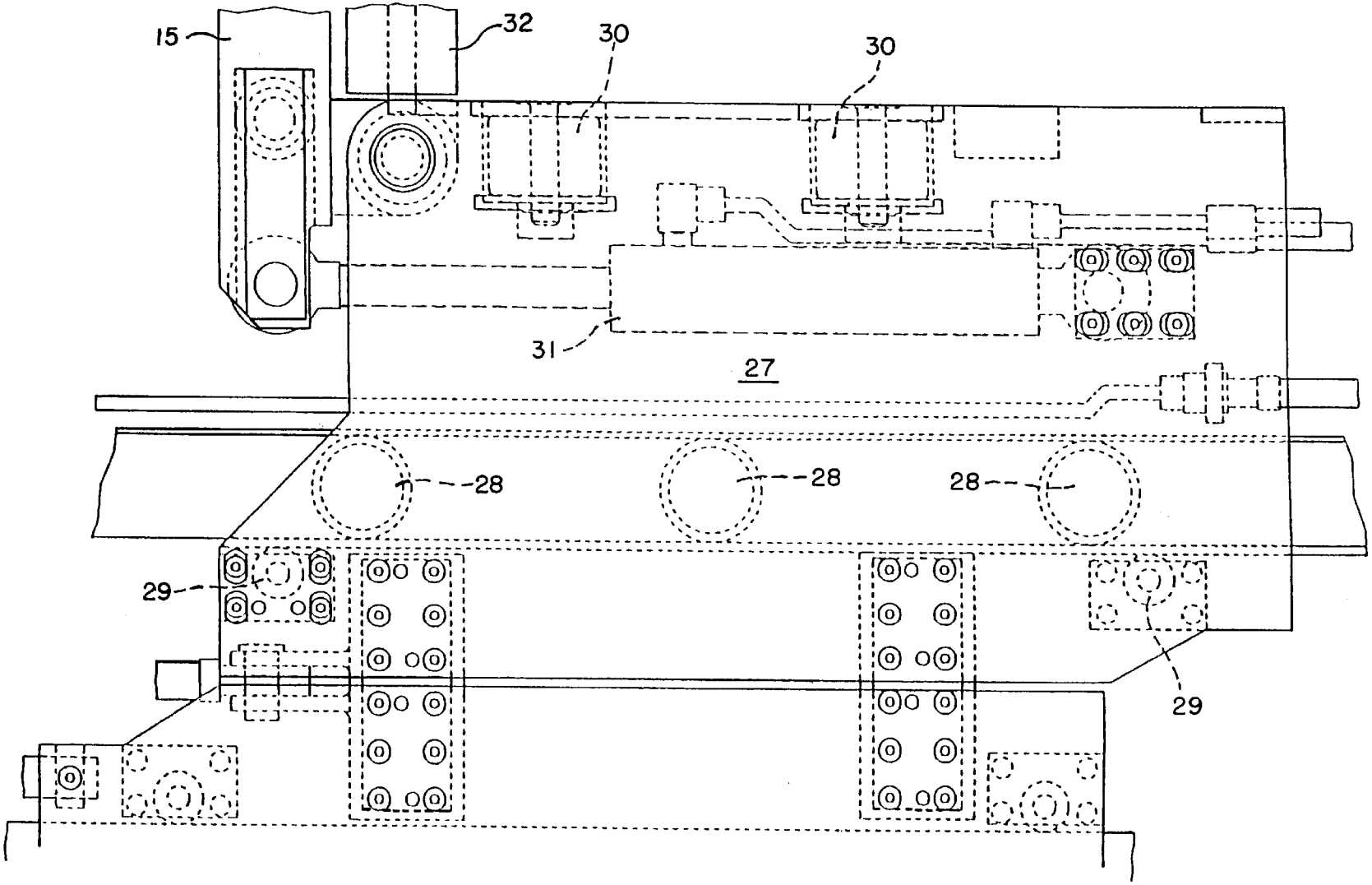
FIG. 5 shows an enlarged top view onto a part of the sledge.
Figure 6:
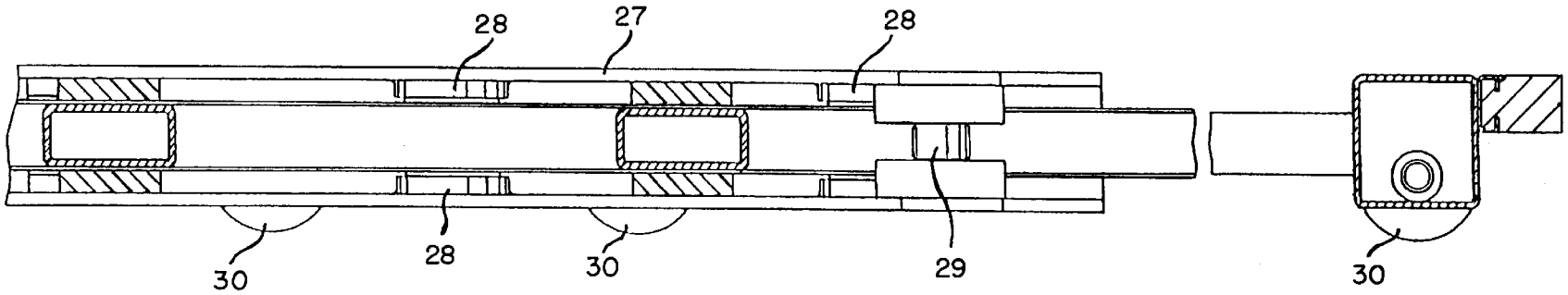
FIG. 6 shows an enlarged side view of the sledge.

The rear carrier arms 15, 16 are pivotally mounted on a sledge 27 which again is supported on the longitudinal carriers 17 with the aid of PTFE slide bearings 28 (see FIG. 5 and 6) in a vertical direction and is supported on the longitudinal carriers 17 with the aid of support rolls 29 in a horizontal direction. The longitudinal carriers and the sledge are movable on the running face 23 with the aid of running wheels 30, when the sledge is unloaded and the carrier arms 15 or 16, respectively, are swung in. The pivotal movement of the carrier arms can be effected with the aid of hydraulic cylinders 31. During pivoting in the respective carrier arm 14, 15, 16 is moved along an inclined plane so that the roller 32 is lifted from the running face 23.

The adjustment of the distance between the front carrier arms 13, 14 and the rear carrier arms 15, 16 is effected by adjusting the sledge in direction of arrow 33 with the aid of the hydraulic cylinder 34.

A transport means, a synchronous belt drive 35 in particular, is provided on each of the four tender arms 6 for the longitudinal movement of the frame means 12. The synchronous belt drive 35 comprises an endless toothed belt 36 which is guided over horizontal toothed disks 37, 38 supported on the inner and outer, respectively, ends of the tender carrier arm 6. With the inside end the transmitter device is connected to the toothed belt 36 by means of a clamp connector and thus, depending on the direction of rotation of the driven toothed disks 37, 38, a vehicle can in an extending manner be pushed into a parking box or, respectively, pulled back from the parking box back onto the tender arm. When picking up a parked vehicle 8 from a parking box 3, the transmitter device 9 is shifted from the tender arm 6 into the direction of the parking box to such extent until the two rigid carrier arms 13 are about at the level of the front edge of the front wheels 10. The two pivotable carrier arms 14 up to this position still are in their rest position, i.e. they extend in parallel to the two longitudinal carriers 17. Thereby, they can be pushed through between the two front wheels 10.

As soon as the rigid carrier arms 13 are in their end position and the transmitter device 9 stops, the two pivotable carrier arms 14 are pivoted by 90° into a position in parallel to the rigid carrier arms with the aid of the hydraulic cylinders 31. In the end phase of the pivotal movement the swing arms 14 bear against the backside of the front wheels 10 and press the front wheels in upward direction during the remaining pivot up to the final parallel position. Thereby the two front wheels 10 are lifted from the bottom sheet of the parking box 3.

The transmitter device 9 now again is pulled back indirection the tender center by the synchronous belt drive 35 and thus drags the vehicle rolling on the two rear wheels 11 onto the tender arm. In this position now the tender 5 and the corresponding tender arm 6, respectively, are moved to the exit platform, the transmitter device 9 then shifts the vehicle 8 on its two free-rolling rear wheels 11, in a reverse driving direction, into the exit box. The two swing arms 14 again are pivoted back into their rest positions in parallel to the longitudinal carriers 17 of the frame means 12, whereby the two front wheels 10 are lowered onto the parking place of the exit box. Subsequently, the transmitter device 9 can be retracted onto the tender arm.

If the vehicle is to be transferred from an entry box into a parking box in piggyback manner, the rear swing arms 15, 16 pivotally supported on the sledge 27 are employed. The hydraulic cylinder 34 arranged between the two longitudinal carriers 17 displaces the sledge 27 until the level of the two rear wheels 11 of the vehicle, where the sledge travel is stopped in sensor-controlled way.

Subsequently, the two carrier arms 15, 16 arranged on the right-hand and left-hand sides on the shiftable sledge 27 are pivotally extended in counter-sense of rotation by 90°. Therein, the carrier arm 15 bears against the front side of the rear wheel 11 and the carrier arm 16 bears against the rear side of the corresponding other rear wheel 11. Depending on the distance of the two pivotable carrier arm longitudinal axes and the diameter of the rear wheel of the vehicle, the two rear wheels in the end phase of the pivotal movement are lifted. Due to the arrangement of the one pivotable carrier arm 15 in front of one rear wheel 11 and of the other pivotable carrier arm 16 behind the other rear wheel 11, the horizontal forces created during contact of the carrier arms with the rear wheel tires counterbalance each other.

In FIGS. 7 and 8, a platform 40 of a parking place 3 is shown in top and sectional view. The platform 40 comprises a metal sheet 41 with laterally set edges 26, extending over a maximum vehicle length and lying on a frame construction 42. The frame construction comprises two longitudinal carriers 43 absorbing the individual loads attacking in variable positions, which carriers are supported on at least two cross carriers 44, 45 transferring the loads into building posts 46. The inside platform end 47 is supported on consoles of the tender running rail 4 via a cross carrier 48.

Flats 49 are mounted, screwed on in particular, for fixing the front wheels 10 of a vehicle 8 on the upper side of the sheet metal 41. These flats are arranged with an angle to the longitudinal axis of the platform 40 so that de-icing water collecting between the flats 49 can flow away to the outside of the platform, because the flats have an inclination of about 2 percent from the inside to the outside. A gap 51 through which the melted ice or rain can flow away is located between the housing wall and the outer platform end 50. Also the lateral set edges 26 prevent a lateral flowing away of the water rinsing down from the vehicles.

Figures 2, 3:
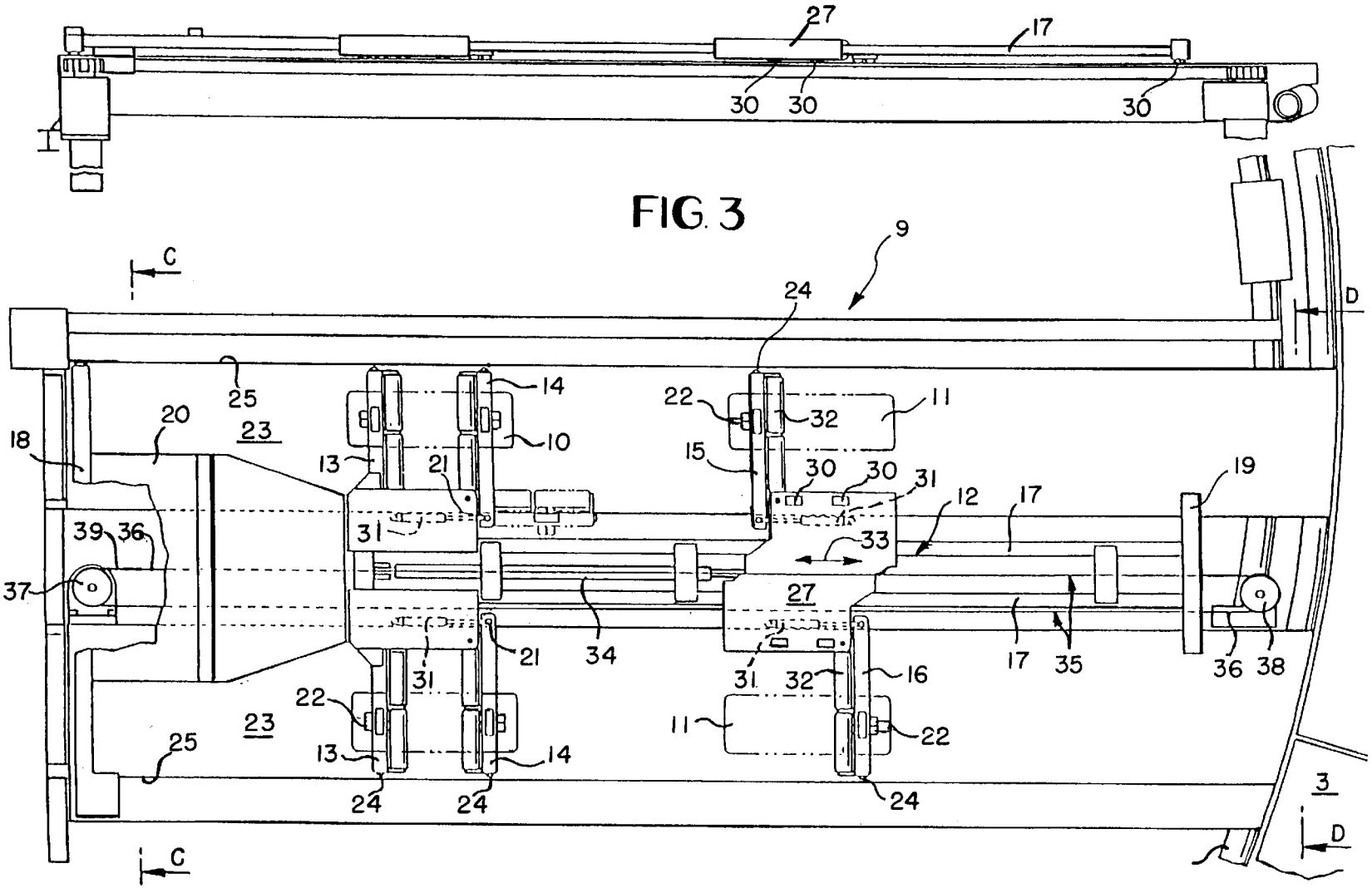
FIG. 2 shows a top view onto a transmitter device supported on a tender arm.
FIG. 3 shows a side view of the transmitter device.
Figure 4A:
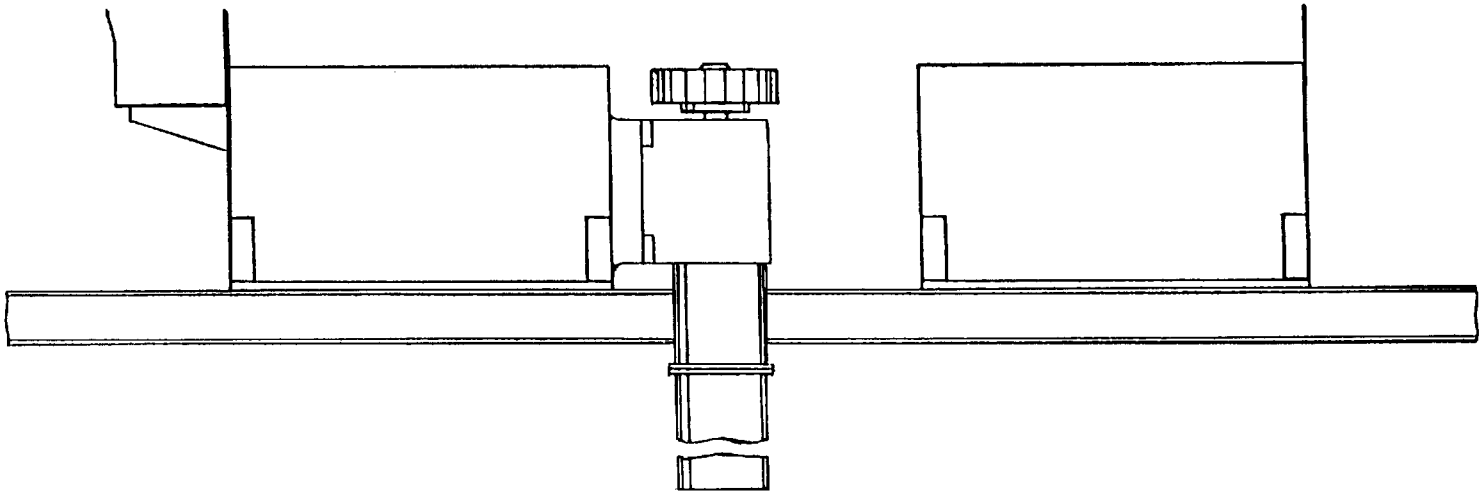
FIGS. 4A and 4B show sectional views along the cutting lines C—C (FIG. 4*a*) and D—D (FIG. 4*b*) of FIG. 2.
Figure 4B:
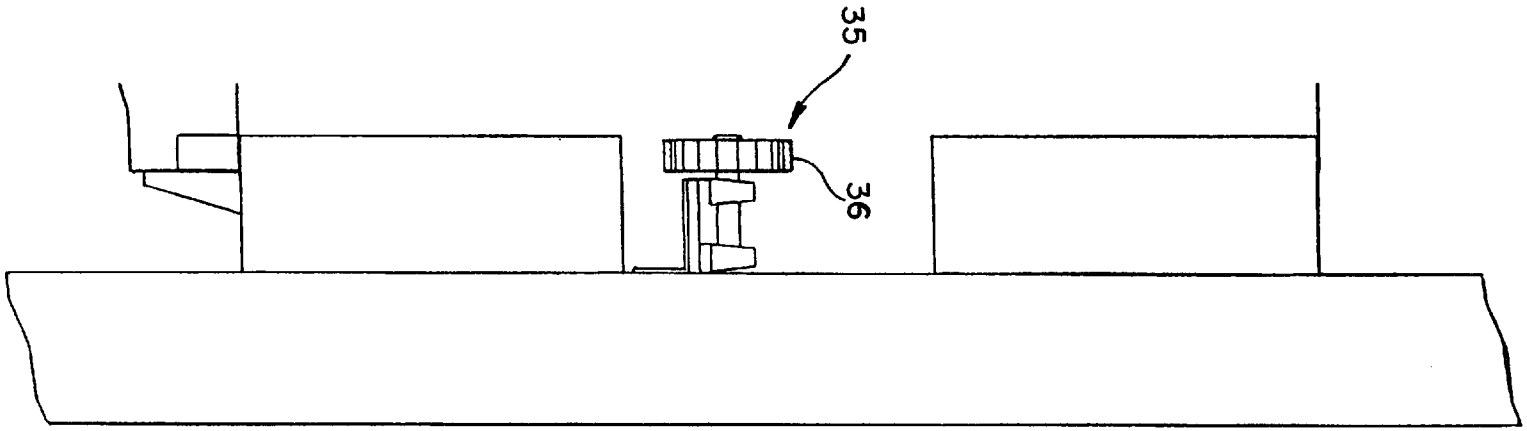
Figure 9:
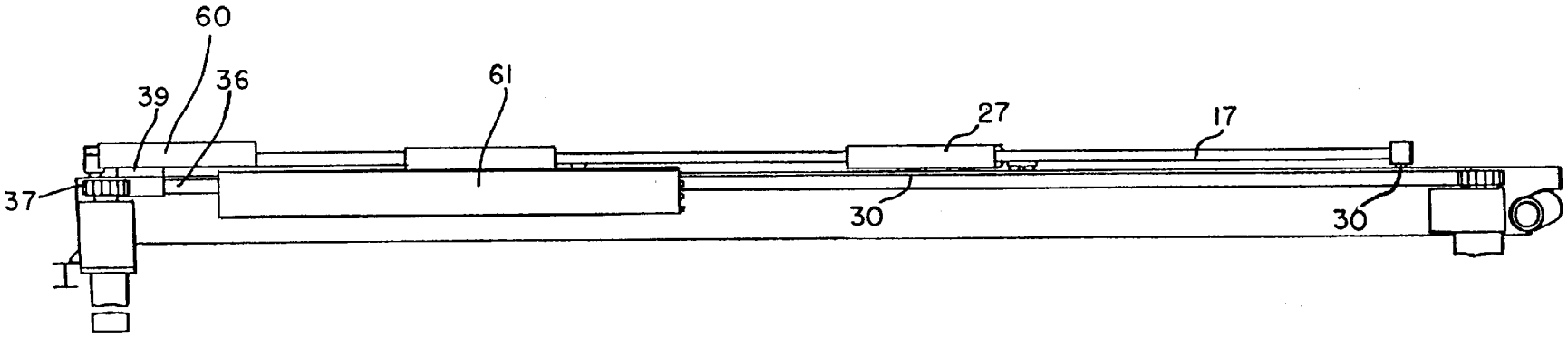
FIG. 9 shows a side view of the transmitter device, a pole being provided for therein.
Figure 10:
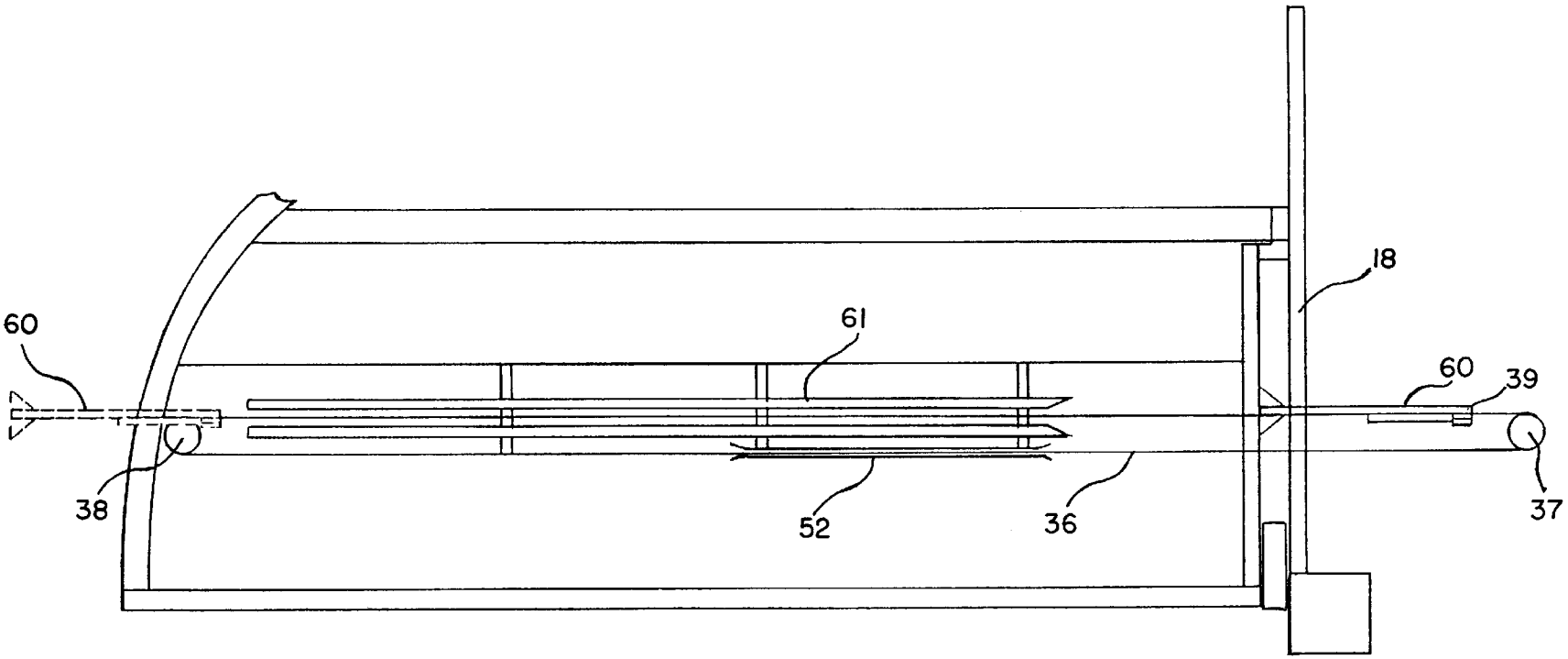
FIG. 10 shows a cut top view onto the transmitter device with a pole.

Alternatively to the arrangement of the transport device shown in FIG. 3, in accordance with FIGS. 9 and 10 a pole 60 can be provided for between the clamping connector 39 and the transmitter device. Therein, the pole 60 prolongates the radius achieved by means of the transport device. The length of the pole preferably amounting to between 1 and 2 m. The transmitter device (here shown in part only) can be shifted to the outside further into the entry and exit boxes by the amount of the pole length. The maximally extended position of the pole 60 therein is shown in dashed line.

The toothed belt 36 is guided in a toothed belt guide 52 for preventing jamming or lateral moving-out of the toothed belt 36.

Figure 11:
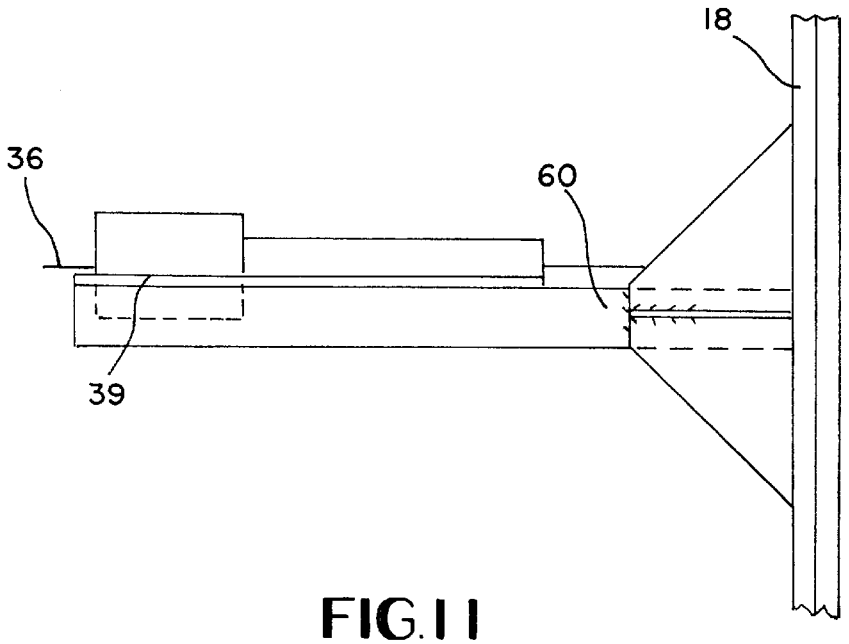
FIG. 11 shows an enlarged top view onto the pole.

FIG. 11 shows a top view of the pole 60. On its one end the pole 60 is screwed to the cross carrier 18 and welded thereto. On the other end of the pole 60 a clamping connector 39 is provided for which connects the pole 60 with the toothed belt 36.

Figure 12:
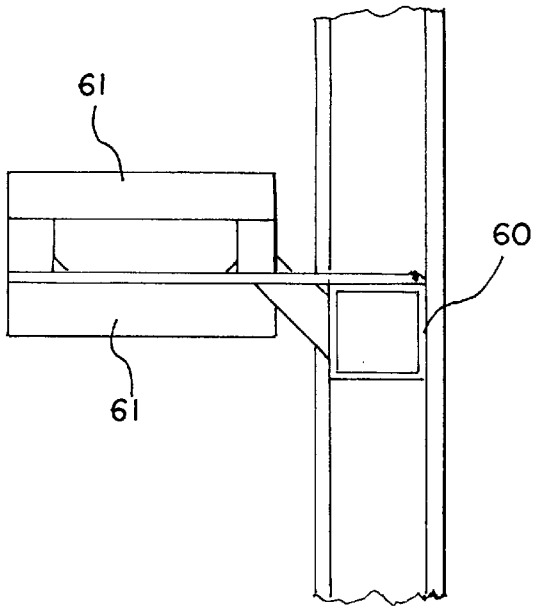
FIG. 12 shows an enlarged cut side view of the pole.

In FIG. 12 a side view of the pole 60 and of a part of the pole guide 61 is shown. The pole has a hollow square profile to which a guide sheet is welded to which two plastic plates are screwed. The plastic plates of the pole guide 61 guarantee low-friction sliding in the rails of the pole guide. By means of the pole guide 61, the transmitter device can be accurately moved into the parking boxes also in the beginning area of the parking boxes in which no lateral sheets are provided for guiding the sledge.

Figure 13:
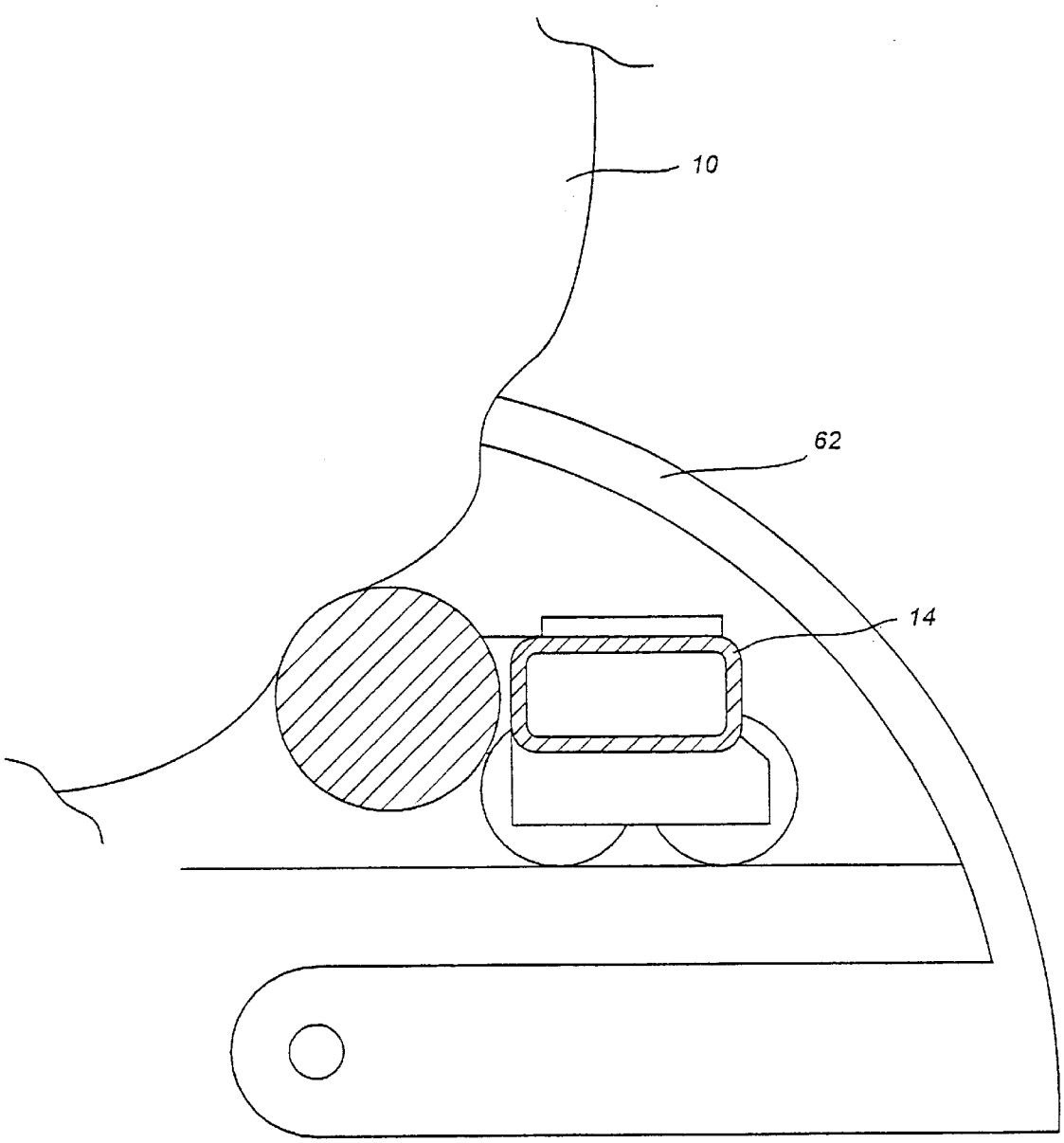
FIG. 13 shows an enlarged section of a secured wheel in a side view.

In FIG. 13 an enlarged section of a front wheel 10 supported on two carrier arms 13 and 14 is shown. For securing the front wheel 10 from being displaced, a bow 62 is arranged on the backside thereof. The bow is pressed against the backside of the front wheel 10. The bow 62 is pivotally arranged on the tender arm. It also is possible to arrange the bow 62 on the transmitter device 5 itself.

Figure 14:
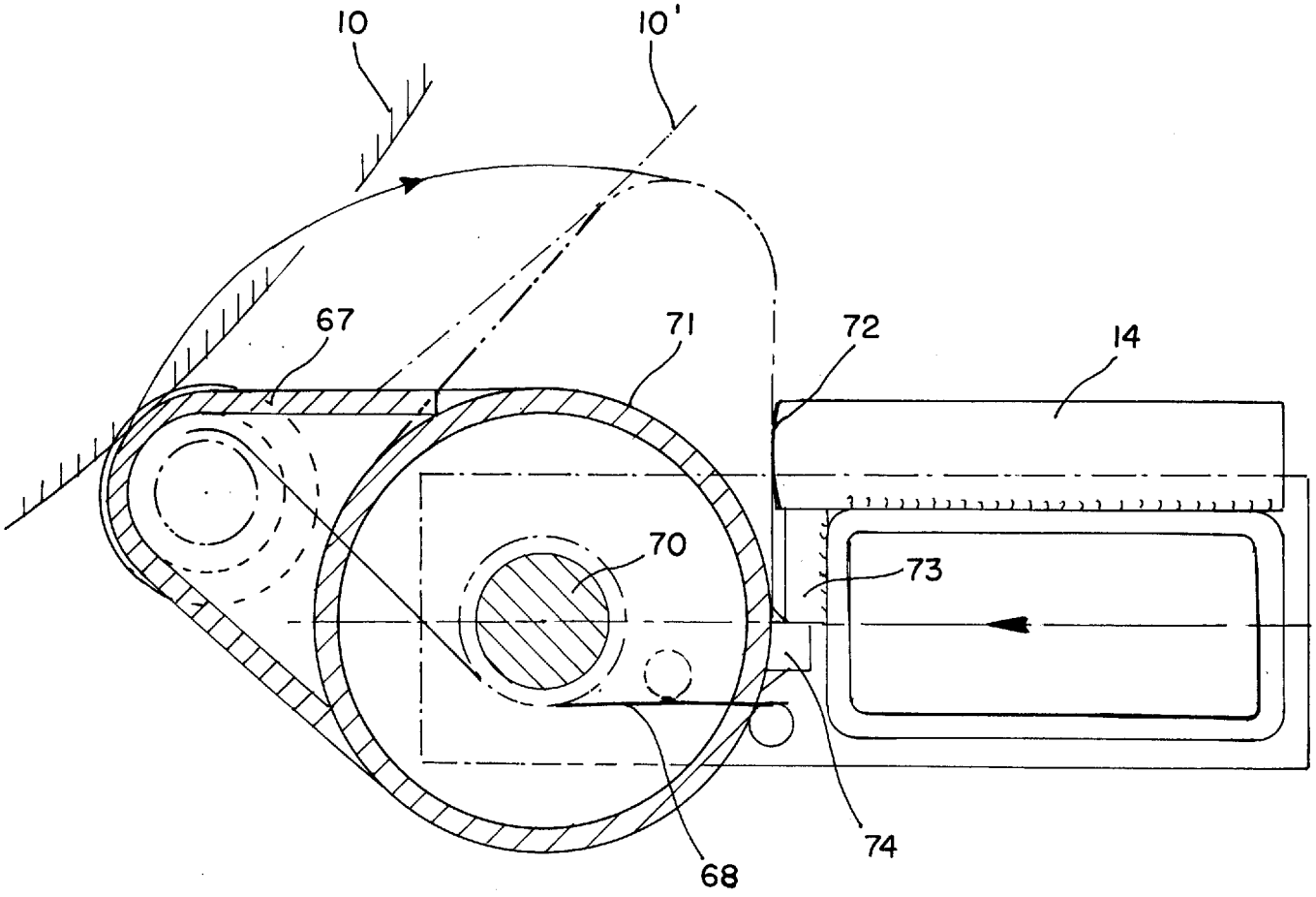
FIG. 14 shows an enlarged section of a secured wheel of the further embodiment in a side view.

In FIG. 14 a further possibility for securing a front wheel 10 supported on two carrier arms is shown. For securing the wheel against displacement, a swing lever 67 rotatably connected to the swing arm 14 is arranged on the backside thereof.

The swing lever 67 is supported on the swing arm axis 70 by means of a ball bearing. The swing lever 67 therein comprises a tube 71 to whose one end the ends of a V-shaped nose are welded. When the swing arm 14 of the transmitter device is pressed against the backward side of the front wheel, the swing lever 67 turns in clockwise direction to an upright position. When the swing lever 67 reaches its end position, the swing lever 67 stops against a stop 72 and the tire 10 is in an elevated position 10'. When the vehicle is to be put down again and the carrier arm 14 is swung back, the swing lever 67 due to the leg spring 68 again rotates back to its basic position. When reaching the basic position, a stop 74 welded to the tube 71 hits an end piece 73 welded to the carrier arm 14.

Figure 15:
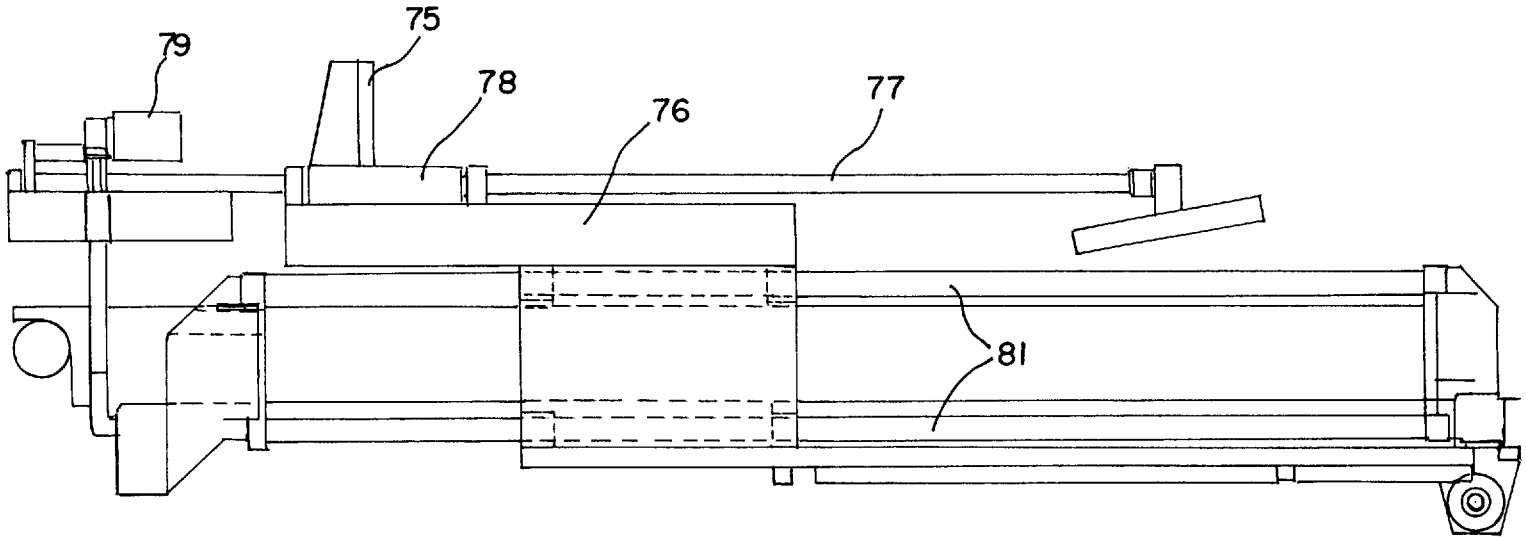
FIG. 15 shows a side view of a swing barrier arranged on the tender.
Figure 16:
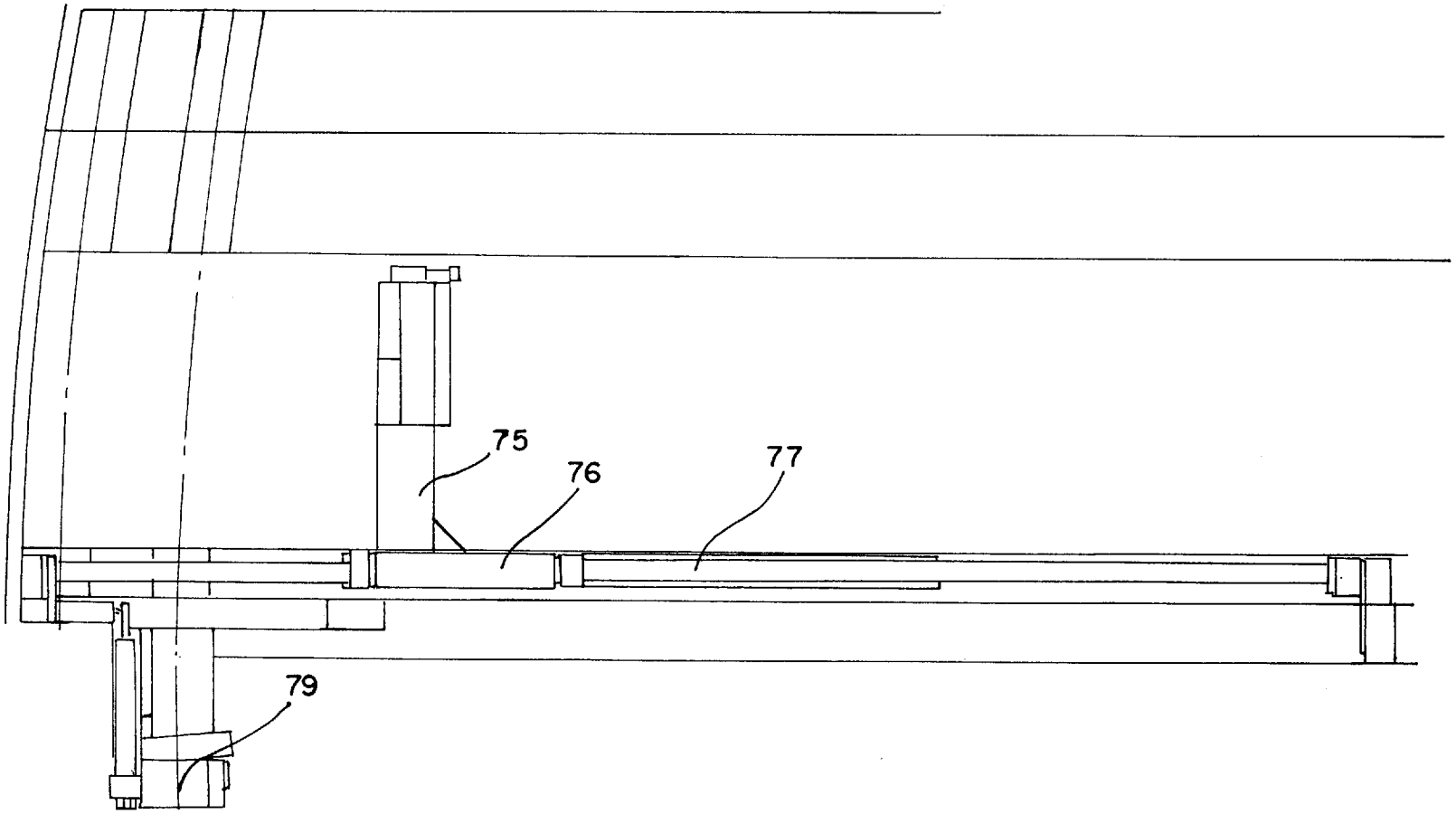
FIG. 16 shows a top view onto the swing barrier of FIG. 15.
Figure 17:
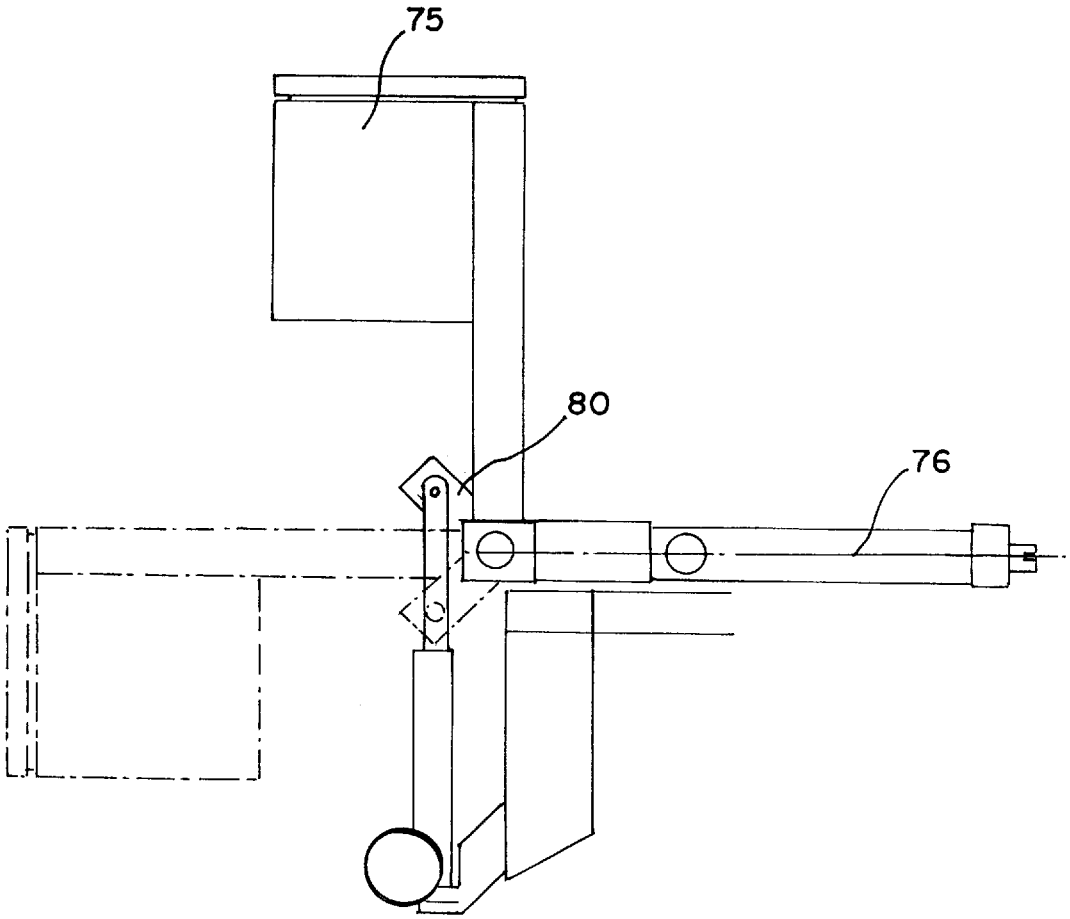
FIG. 17 shows a front view of the swing barrier of FIGS. 15 and 16.

In FIGS. 15 to 17, a further embodiment for securing the vehicle on the tender is shown. A swing barrier 75 is pivotally supported on a sledge 76. The sledge 76 is displaceable on two guide rods 81 in longitudinal direction of the tender. Shifting is effected by means of a chain wheel mounted on the tender arm, which engages with a chain rack fixed to the sledge.

A spline shaft 77 is rotatably supported in two pedestal bearings in a truss girder of the tender. The swing barrier 75 is welded to a hollow square profile 78. Two inserts forming the counter-profile to the spline shaft 77 are welded into the hollow profile 78. The spline shaft 77 can be turned by 90° via a linear drive 79 by means of a lever 80 arranged on the spline shaft 77. When the sledge shifts along the tender arm, the hollow square profile 78 slides over the spline shaft 77.

In an embodiment of the invention, the vehicle is secured by a swing lever 67 on the front wheel and a swing barrier 75 on the bumper. Therein, the swing barrier 75 must be displaceable for accommodating different types of vehicles.

Furthermore, the bumpers only can absorb a restricted force in direction of the vehicle. For this reason, a distribution of the centrifugal force acting on the vehicle onto both holding means is effected. For this purpose, use is made of the fact that the tire has a certain elasticity. In rest position of the tender the swing barrier 75 at first remains 1 to 2 cm behind the bumper of the vehicle. As soon as the tender rotates and a centrifugal force acts on the vehicle, the vehicle is displaced to the outside due to the elasticity of the front tires so that now the swing barrier 75 bears on the bumper of the vehicle. The portion of centrifugal force which is transferred to the swing barrier 75 can be adjusted by adjusting the distance between the bumper and the swing barrier 75. Moreover, due to the arrangement of two devices for securing the vehicles on the tender, the system has an advantageous redundancy.

Figure 18:
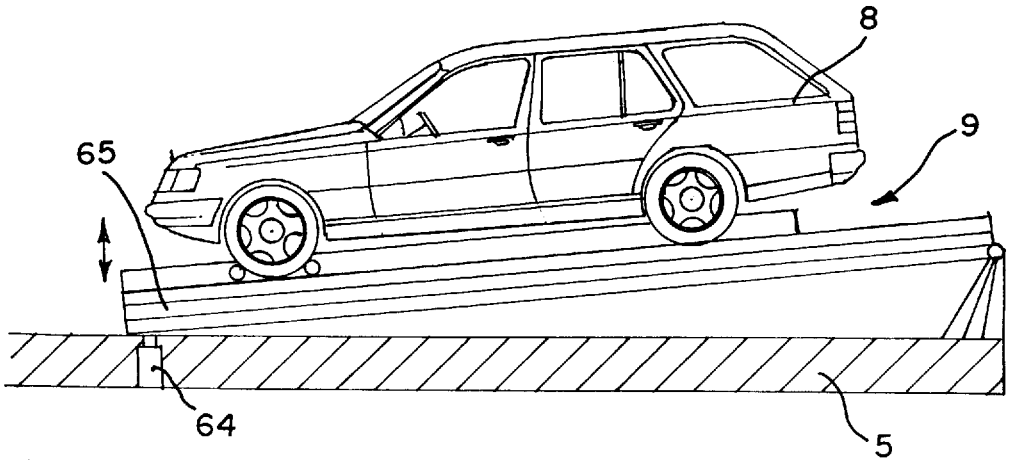
FIG. 18 shows a side view of the transmitter device on the tender with a vehicle, wherein a tilting means is provided for, and FIG. 19 shows an enlarged section of a wheel with a self-locking barrier.

An alternative possibility for securing a vehicle 8 is shown in FIG. 18. After accommodation of the vehicle 8 on the transmitter device 9 the transmitter device is rolled onto a tilting device 65 arranged on the tender 5. After the transmitter device 9 reached its final position, the tilting device 65 is lowered in direction of the front face of the vehicle by means of a lifting means 64, whereby the transmitter device 9 assumes an inclined position. By the inclined position a displacement of the vehicle 8 in backward direction with respect to the transmitter device 9 due to centrifugal forces during rotation of the tender is avoided.

Figure 19:
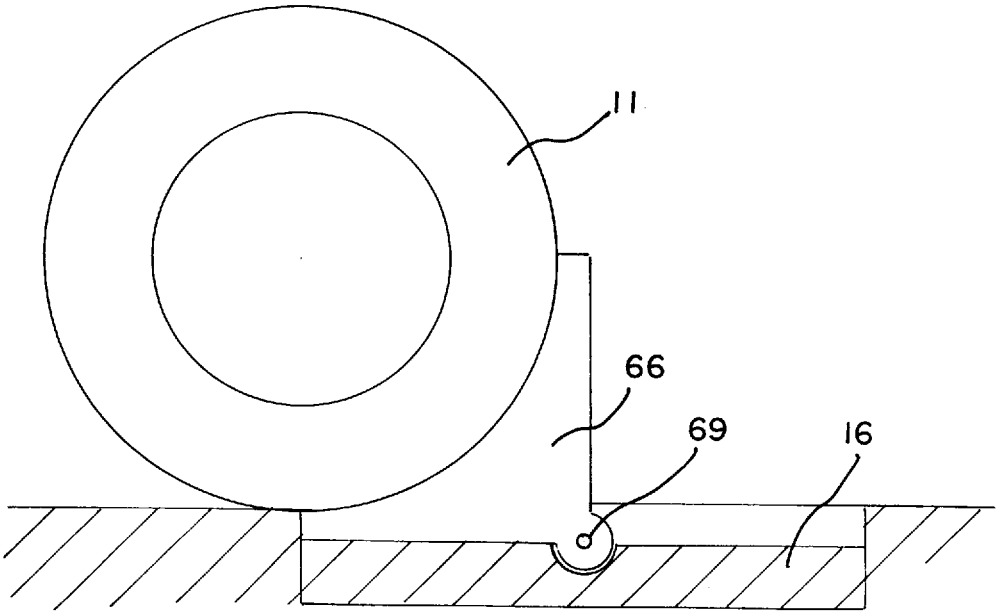

In FIG. 19 a further possibility for securing a wheel of a vehicle 8 is shown. The wheel, in this case the rear wheel 11, is secured by means of a self-locking barrier 66. The barrier 66 is pivotally arranged on the tender 5. Therein, it is possible to lower the barrier 66 in upward direction such that the front wheels can roll over the area of the barrier 66. When the vehicle 8 is rolled onto the transmitter device 9, the rear wheel 11 is rolled over the barrier 66, wherein the barrier 66 is pivoted by 90° and the rear wheel is secured against displacement. A torsion spring 69 with which the barrier 66 is pretensioned therein is provided for the barrier 66 so that the barrier 66 safely is held in a position in which reception of the vehicle is possible.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A system for receiving, temporarily storing, and outputting vehicles, the system comprising:

a helical running rail;

a plurality of parking platforms spaced in an elevational manner adjacent to said helical rail, said parking platforms are supported by a plurality of beam structures outside said helical rail;

a tender rotatably supported on a central frame structure within said helical running rail;

a vehicle support structure extending from said tender, said vehicle support structure contacts said helical rail, said vehicle support structure further includes:

at least two running face platforms slidably mounted to said helical rail and rotatably mounted to said central frame structure;

a transmitter device supported by at least one of said two running face platforms and said parking platforms, said transmitter device includes:

an adjustable carrier frame;

a first set of wheel carrier arms, said first set of wheel carrier arms includes two stationary arms and two pivotable arms, said first set of wheel carrier arms are mounted to said carrier frame;

first means for pivoting said pivotable arms of said first set of wheel carrier arms in extended and retracted positions;

a polygonal shaped sledge having corners, said sledge is mounted to said carrier frame;

a second set of wheel carrier arms, said second set of wheel carrier arms include two pivotable arms mounted to said sledge at diagonally spaced pivot points;

second means for pivoting said second set of said of wheel carrier arms in extended and retracted positions which are relatively opposite to each other, each wheel carrier arm including a beam supporting a plurality of wheel support rollers spaced and running rolls;

wheel base means for adjusting a distance between said sledge relative to said first set of wheel carrier arms; and means for moving said transmitter device across said running face platforms and said parking platforms, said first and second set of wheel carrier arms elevate the wheels of a vehicle in the extended positions so that the wheels of the vehicle are spaced from said running face platforms while the wheels contact said wheel support rollers, and said running rolls contact at least one of said running face platforms and said parking platforms for automated parking of a vehicle.

2. The system for receiving, temporarily storing, and outputting vehicles as defined in claim 1, wherein all of said pivotable wheel carrier arms are parallel to said carrier frame in the retracted positions and said wheel carrier arms are perpendicular to said carrier frame in the extended positions.

3. The system for receiving, temporarily storing, and outputting vehicles as defined in claim 1, wherein said carrier frame includes two longitudinal beams parallel to said running face platforms attached to said sledge, said two longitudinal beams are attached together by a plurality of cross beams perpendicular to said running face platforms.

4. The system for receiving, temporarily storing, and outputting vehicles as defined in claim 3, wherein said sledge and at least one of said cross beams include running wheels which space said transmitter device from said two running face platforms, whereby running wheels of said sledge contact said two running face platforms when said wheel carrier arms of said sledge are in the retracted position.

5. The system for receiving, temporarily storing, and outputting vehicles as defined in claim 1, wherein said wheelbase means for adjusting a distance between said sledge relative to said first set of wheel carrier arms includes a hydraulic piston/cylinder arrangement.

6. The system for receiving, temporarily storing, and outputting vehicles as defined in claim 1, wherein said running face platforms include a lateral set of edges which extend from said running face platforms in a substantially perpendicular manner.

7. The system for receiving, temporarily storing, and outputting vehicles as defined in claim 6, wherein each beam of each wheel carrier arm includes a guide roll which contacts at least one of said lateral edges of said running face platforms when each wheel carrier arm is in the extended position.

8. The system for receiving, temporarily storing, and outputting vehicles as defined in claim 1, wherein each of said running rolls are disposed in a substantially central area of its respective beam.

9. The system for receiving, temporarily storing, and outputting vehicles as defined in claim 1, wherein said first and second means for pivoting said first and second set of wheel carrier arms include a hydraulic piston/cylinder arrangement.

10. The system for receiving, temporarily storing, and outputting vehicles as defined in claim 1, wherein said means for moving said transmitter device across said running face platforms and said parking platforms includes a motor and a synchronous belt drive coupled to said transmitter device for longitudinal movement of said transmitter device.

11. The system for receiving, temporarily storing, and outputting vehicles as defined in claim 10, wherein said synchronous belt drive includes an endless toothed belt guided over a plurality of toothed disks, each disk being rotatably supported on said vehicle support structure and disposed in a central region between said two running face platforms.

12. The system for receiving, temporarily storing, and outputting vehicles as defined in claim 10, wherein said motor and said tender are electrically driven.

13. The system for receiving, temporarily storing, and outputting vehicles as defined in claim 10, further comprising:

control means for activating said means for moving said transmitter device and said second means for pivoting said first and second set of wheel carrier arms, said control means calculates whether current consumption exceeds a given threshold value of said motor of said synchronous belt drive.

14. The system for receiving, temporarily storing, and outputting vehicles as defined in claim 10, wherein said synchronous belt drive further includes a pole coupled to the synchronous belt drive, said pole contacts said transmitter device at predetermined positions along said belt drive to increase translational movement of said transmitter device.

15. The system for receiving, temporarily storing, and outputting vehicles as defined in claim 14, wherein said pole has a substantially square cross section.

16. The system for receiving, temporarily storing, and outputting vehicles as defined in claim 14, wherein said pole is secured against at least one of twisting and torsion by a pole guide mounted to said vehicle support structure in a central region between said two running face platforms.

17. The system for receiving, temporarily storing, and outputting vehicles as defined in claim 16, wherein said pole guide includes two plates which enclose a portion of said synchronous belt drive.

18. The system for receiving, temporarily storing, and outputting vehicles as defined in claim 1, wherein said sledge is mounted to said carrier frame by a plurality of bearings.

19. The system for receiving, temporarily storing, and outputting vehicles as defined in claim 18, wherein said bearings are polytetrafluorethylene slide bearings.

20. The system for receiving, temporarily storing, and outputting vehicles as defined in claim 1, wherein each parking platform is made of sheet metal having a length which extends beyond a length of a vehicle, each parking platform further includes a lateral set of edges which extend from each parking platform in a substantially perpendicular manner.

21. The system for receiving, temporarily storing, and outputting vehicles as defined in claim 20, wherein each parking platform is supported by a plurality of longitudinal beams extending in a direction parallel to the length of each platform, each of said plurality of longitudinal beams extending in a direction parallel to the length of each platform is mounted to a plurality of beams positioned at an angle relative to said longitudinal beams, each of the plurality of beams positioned at an angle relative to said longitudinal beams is mounted to a plurality of beams extending substantially perpendicular to the longitudinal beams.

22. The system for receiving, temporarily storing, and outputting vehicles as defined in claim 20, wherein said sheet metal is made from ferritic chromium-alloyed steel which is resistant against corrosion from de-icing salt solutions and wear.

23. The system for receiving, temporarily storing, and outputting vehicles as defined in claim 1, wherein each parking platform includes a plurality of flat members mounted to a surface of each parking platform, said flat members channel at fluids off the surface of each parking platform.

24. The system for receiving, temporarily storing, and outputting vehicles as defined in claim 1, wherein said means for moving said transmitter device across said running face platforms and said parking platforms moves said transmitter device at a first speed and a second speed, the first speed is greater than the second speed, said transmitter device in an unloaded state is moved at the first speed and said transmitter device in a loaded state is moved at the second speed.

25. The system for receiving, temporarily storing, and outputting vehicles as defined in claim 1, wherein said vehicle support structure further includes means for securing a position of a vehicle on said vehicle support platform to prevent displacement of the vehicle.

26. The system for receiving, temporarily storing, and outputting vehicles as defined in claim 25, wherein said securing means includes a least one pivotable bow structure.

27. The system for receiving, temporarily storing, and outputting vehicles as defined in claim 25, wherein said securing means includes a swing lever mounted to at least one of said wheel carrier arms of said first set of wheel carrier arms.

28. The system for receiving, temporarily storing, and outputting vehicles as defined in claim 25, wherein said securing means includes a foldable swing barrier which is adapted to engage a bumper of a back side of a vehicle.

29. The system for receiving, temporarily storing, and outputting vehicles as defined in claim 25, wherein said securing means includes a swing lever mounted to at least one of said wheel carrier arms of said first set of wheel carrier arms and a foldable swing barrier which is adapted to engage a bumper of a back side of a vehicle.

30. The system for receiving, temporarily storing, and outputting vehicles as defined in claim 1, further comprising:

entry and exit platforms; and means for closing said entry and exit platforms, said means for closing said entry and exit platforms includes a structure which is foldable and separates the vehicle support structure from at least one of said entry and exit platforms when extended to prevent injury to people adjacent said vehicle support structure.

* * * * *